US008059990B2

(12) United States Patent
Kurimoto et al.

(10) Patent No.: US 8,059,990 B2
(45) Date of Patent: Nov. 15, 2011

(54) IMAGE FORMING APPARATUS

(75) Inventors: Eiji Kurimoto, Numazu (JP); Keisuke Shimoyama, Numazu (JP); Shinich Kawamura, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 667 days.

(21) Appl. No.: 11/747,239

(22) Filed: May 11, 2007

(65) Prior Publication Data

US 2007/0264047 A1 Nov. 15, 2007

(30) Foreign Application Priority Data

May 12, 2006 (JP) ..... 2006-133250

(51) Int. Cl.
*G03G 15/00* (2006.01)

(52) U.S. Cl. .... 399/159; 430/58.5; 430/59.5; 430/125.2

(58) Field of Classification Search ..... 399/159; 430/58.5, 59.5, 125.2
See application file for complete search history.

(56) References Cited

U.S. PATENT DOCUMENTS 4,897,333 A * 1/1990 Matsushita ..... 430/119.71
5,576,131 A * 11/1996 Takai et al. ..... 430/59.2
5,578,405 A 11/1996 Ikegami et al.
5,702,855 A 12/1997 Ikegami et al.
5,976,746 A 11/1999 Tanaka et al.
6,045,959 A 4/2000 Katayama et al.
6,066,428 A 5/2000 Katayama et al.
6,130,310 A 10/2000 Katayama et al.
6,172,176 B1 1/2001 Tanaka et al.
6,187,492 B1 2/2001 Ri et al.
6,187,494 B1 2/2001 Kawamura et al.
6,194,535 B1 2/2001 Katayama et al.
6,210,848 B1 4/2001 Nagai et al.
6,303,736 B1 10/2001 Kawamura et al.
6,432,596 B2 8/2002 Ikuno et al.
6,444,387 B2 9/2002 Ri et al.
6,486,293 B1 11/2002 Ri et al.
6,492,079 B2 12/2002 Shimada et al.
6,548,216 B2 4/2003 Kawamura et al.
6,573,016 B2 6/2003 Kami et al.
6,576,386 B1 6/2003 Ri et al.
6,596,449 B2 7/2003 Shimada et al.
6,641,964 B2 11/2003 Ikuno et al.
6,653,033 B1 11/2003 Kami et al.
6,664,361 B2 12/2003 Sasaki et al.
6,790,571 B2 9/2004 Kawamura et al.
6,790,572 B2 9/2004 Tamoto et al.
6,794,102 B2 9/2004 Bender et al.
6,824,939 B2 11/2004 Kurimoto et al.
6,844,124 B2 1/2005 Ikuno et al.
6,853,823 B2 2/2005 Sugino et al.
6,853,834 B2 2/2005 Kurimoto et al.
6,858,362 B2 2/2005 Tamoto et al.
6,919,419 B2 7/2005 Ri et al.
6,936,388 B2 8/2005 Suzuki et al.
6,939,651 B2 9/2005 Li et al.
6,974,654 B2 12/2005 Kawamura et al.
7,056,633 B2 6/2006 Kawamura et al.
7,060,404 B2 6/2006 Kami et al.
7,071,285 B2 7/2006 Kawamura et al.

(Continued)

FOREIGN PATENT DOCUMENTS

JP 57-148745 9/1982

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Oblon, Spivak, McClelland, Maier & Neustadt, L.L.P.

(57) ABSTRACT

An image forming apparatus having an image bearing member having a substrate and a photosensitive layer having a charge generating layer and a charge transport layer, a charging device for uniformly charging the surface of the image bearing member, an irradiating device having a light source for irradiating the image bearing member to form a latent electrostatic image thereon, a developing device for developing the latent electrostatic image, a transfer device for transferring the developed image to a recording medium and a cleaning device for cleaning the surface of the image bearing member, wherein the charge transport layer contains a charge transport material represented by the following chemical formula, the light source emits light having a wavelength not less than 600 nm and the image bearing member is not irradiated with light having a wavelength less than 600 nm, wherein R1 and R2 independently denote a hydrogen atom, a substituted or non-substituted alkyl group, a substituted or non-substituted cycloalkyl group, a substituted or non-substituted aralkyl group, R3, R4, R5, R6, R7, R8, R9 and R10 independently denote a hydrogen atom, a halogen atom, cyano group, nitro group, amino group, hydroxyl group, a substituted or non-substituted alkyl group, a substituted or non-substituted cycloalkyl group, a substituted or non-substituted aralkyl group.

6 Claims, 5 Drawing Sheets

U.S. PATENT DOCUMENTS

| | | | | |
|---|---|---|---|---|
| 2005/0100804 | A1 | 5/2005 | Tamoto et al. | |
| 2006/0134541 | A1* | 6/2006 | Fujii et al. | 430/74 |
| 2007/0059617 | A1* | 3/2007 | Toda et al. | 430/58.05 |
| 2007/0059618 | A1* | 3/2007 | Kurimoto et al. | 430/58.5 |
| 2007/0219375 | A1* | 9/2007 | Fujiyama et al. | 546/278.7 |

FOREIGN PATENT DOCUMENTS

| | | |
|---|---|---|
| JP | 59-031965 | 2/1984 |
| JP | 59-036254 | 2/1984 |
| JP | 59-044054 | 3/1984 |
| JP | 59-049544 | 3/1984 |
| JP | 59-166959 | 9/1984 |
| JP | 61-239248 | 10/1986 |
| JP | 62-067094 | 3/1987 |
| JP | 63-000366 | 1/1988 |
| JP | 63-116158 | 5/1988 |
| JP | 64-017066 | 1/1989 |
| JP | 01-134364 | 5/1989 |
| JP | 3-37671 | 2/1991 |
| JP | 2000-47409 | 2/2000 |
| JP | 2001-019871 | 1/2001 |
| JP | 2001-350329 | 12/2001 |
| JP | 2005-208594 | 8/2005 |
| WO | WO 2005092901 A1 * | 10/2005 |

OTHER PUBLICATIONS

Willy Herbst, et al., "Industrial Organic Pigments," Third, Completely Revised Edition, VCH, 472-487.

U.S. Appl. No. 12/036,779, filed Feb. 25, 2008, Kurimoto, et al.

* cited by examiner

IMAGE FORMING APPARATUS

BACKGROUND OF THE INVENTION

1. Field of the Invention

The present invention relates to an image forming apparatus.

2. Discussion of the Background

As an image bearing member for use in an image forming apparatus applied to a photocopier and a laser printer, inorganic image bearing members formed of, for example, selenium, zinc oxide and cadmium sulfide, used to be widely used. However, in terms of the reduction of burden on environment, cost reduction and design latitudes, organic image bearing member (e.g., organic photoconductors (OPC)) have been diffusing now.

This organic image bearing member can be classified by layer structure. For example, organic image bearing members can be typified into (1) uniform single layer type, in which photoconductive resin (e.g., polyvinyl carbazol (PVK)) or charge transfer complex ((e.g., PVK-TNF (2,4,7-trinitrofluorenone)) is provided on an electroconductive substrate, (2) dispersion single layer type, in which a dispersion where a pigment (e.g., phthalocyanine and perylene) is dispersed in a resin is provided on an electroconductive substrate, and (3) layer accumulation type, in which a photosensitive layer provided on an electroconductive substrate is functionally separated into a charge generation layer (CGL) containing a charge generating material and a charge transport layer (CTL) containing a charge transport material.

The layer accumulation type is advantageous in terms of high sensitivity and has a high design latitude for high sensitivity and high durability. Thus, currently, most of the organic image bearing members adopts this layer structure.

The characteristics of these organic image bearing members are highly dependent on materials, especially charge transfer materials. The charge transfer materials are typified into positive hole transfer materials having a function of transferring positive holes, and electron transfer materials having a function of transporting electrons. Among these, electron transfer materials are demanded because the above-mentioned structure is positively charged, meaning generation of ozone and non-uniformity of charging are little in comparison with negative charging.

However, it is extremely difficult to find excellent electron transfer materials as materials for an image bearing member. For example, there are materials having excellent electron transfer properties with a problem about safety, for example, mutagenic property. Such materials are not suitable for practical use.

In addition, there are electron transfer materials which have no problem about safety but about stability after formation of a layer. To be specific, charging property and potential maintaining property in a dark place and quick light attenuation characteristics during irradiation are gradually lost. Such a material is dissolved over time so that the characteristics thereof deteriorate. This leads to degradation of image quality due to extreme deterioration of electric characteristics over repetitive use.

The issue is that the quality of images is initially good but deteriorates over a long period of time. Therefore, for example, unexamined published Japanese patent application No. (hereinafter referred to as JOP) describes a technology in which various kinds of additives are added in layers of an image bearing member.

However, such additives inhibit electron transfer property inherently seen in an electron transfer material. This causes a side effect, for example, deterioration of sensitivity characteristics. When the addition amount of such an additive increases, a binder resin becomes brittle. This reduction in strength leads to deterioration of anti-abrasion property. Consequently, there is no image forming apparatus which produces quality images for a long-time repetitive use.

SUMMARY OF THE INVENTION

Because of these reasons, the present inventors recognize that a need exists for an image forming apparatus which can restrain deterioration of electric characteristics of an image bearing member for repetitive use for a long period of time, have an excellent mechanical durability and stably produce quality images.

Accordingly, an object of the present invention is to provide an image forming apparatus which can restrain deterioration of electric characteristics of an image bearing member for repetitive use for a long period of time, have an excellent mechanical durability and stably produce quality images.

Briefly this object and other objects of the present invention as hereinafter described will become more readily apparent and can be attained, either individually or in combination thereof, by an image forming apparatus having an image bearing member for bearing a latent electrostatic image and having a substrate and a photosensitive layer including a charge generating layer and a charge transport layer, a charging device for uniformly charging the surface of the image bearing member, an irradiating device including a light source, the irradiating device for irradiating the image bearing member to form a latent electrostatic image on the image bearing member, a developing device for developing the latent electrostatic image with a toner, a transfer device for transferring the developed image to a recording medium and a cleaning device for cleaning the surface of the image bearing member. In addition, the charge transport layer contains a charge transport material represented by the following chemical formula (A), the light source emits light having a wavelength not less than 600 nm and the image forming apparatus is configured such that the image bearing member is not irradiated with light having a wavelength less than 600 nm.

Chemical formula (A)

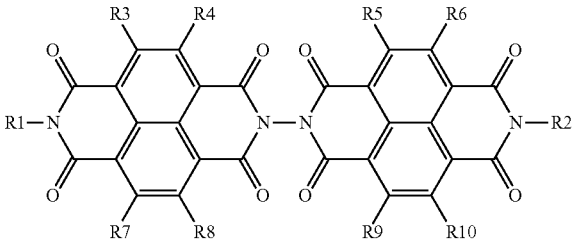

In the Chemical formula (A), $R_1$ and $R_2$ independently denote a hydrogen atom, a substituted or non-substituted alkyl group, a substituted or non-substituted cycloalkyl group, a substituted or non-substituted aralkyl group, and $R_3$, $R_4$, $R_5$, $R_6$, $R_7$, $R_8$, $R_9$ and $R_{10}$ independently denote a hydrogen atom, a halogen atom, cyano group, nitro group, amino group, hydroxyl group, a substituted or non-substituted alkyl group, a substituted or non-substituted cycloalkyl group, a substituted or non-substituted aralkyl group.

According to one embodiment, in the image forming apparatus mentioned above, the light source irradiates the surface of the image bearing member with light having a wavelength not less than 600 nm from between the transfer device and the charging device.

According to another embodiment, in the image forming apparatus mentioned above, the light source is a semiconductor laser (LD) or a light-emitting diode (LED).

According to another embodiment, the charge generating layer contains phthalocyanine.

According to another embodiment, the charge generating layer contains titanyl phthalocyanine.

According to another embodiment, in the image forming apparatus mentioned above, the titanyl phthalocyanine has a spectroscopic having a CuKα X-ray diffraction spectrum having a wavelength of 1.542 Å such that a maximum peak is observed at a Bragg (2θ) angle of 27.2±0.2°, main peaks at a Bragg (2θ) angle of 9.4±0.2°, 9.6±0.2° and 24.0±0.2°, and a peak at a Bragg (2θ) angle of 7.3±0.2° as a lowest angle diffraction peak, and having no peak between 9.4±0.2° and 7.3±0.2°.

According to another embodiment, in the image forming apparatus mentioned above, the photosensitive layer contains a polycarbonate resin.

According to another embodiment, the image forming apparatus mentioned above further includes an intermediate transfer body and the toner image on the image bearing member is primarily transferred to the intermediate transfer body, the toner image on the intermediate transfer body is secondarily transferred to the recording medium, each color toner image is sequentially overlapped on the intermediate transfer body to form an overlapped color image and the overlapped color toner image is secondarily transferred to the recording medium.

As another aspect of the present invention, a process cartridge has an image bearing member for bearing a latent electrostatic image and having a substrate and a photosensitive layer including a charge generating layer and a charge transport layer, an optional charging device for uniformly charging the surface of the image bearing member, an optional developing device for developing the latent electrostatic image with a toner and an optional cleaning device for cleaning the surface of the image bearing member. In addition, the process cartridge can be detachably attached to the image forming apparatus mentioned above.

As another aspect of the present invention, an image forming apparatus has at least two process cartridges mentioned above.

These and other objects features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
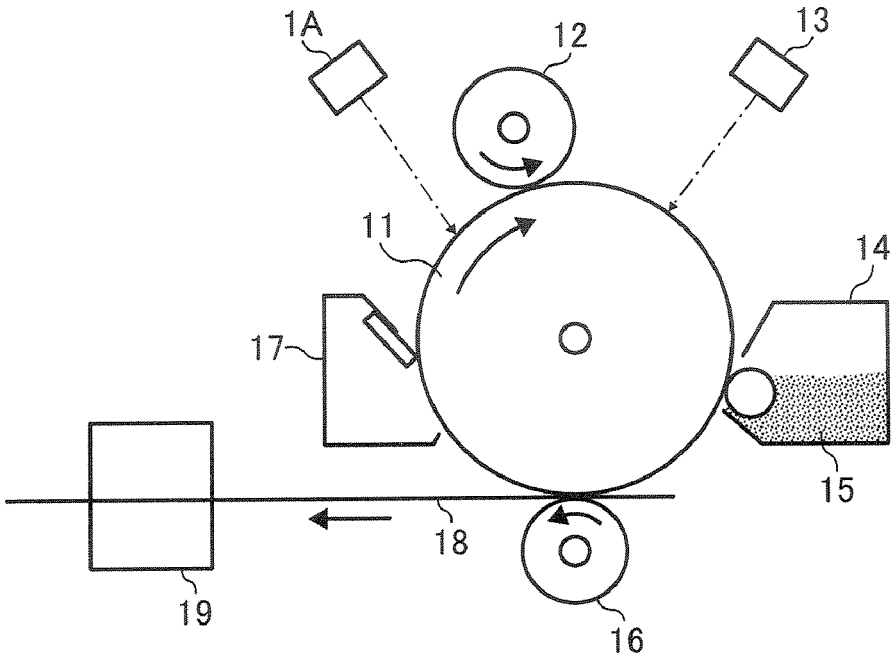
FIG. 1 is a cross section illustrating an example of the image forming apparatus of the present invention.

The present invention will be described below in detail with reference to several embodiments and accompanying drawings.

A specific electron transport material represented by the following chemical formula (A) has an excellent electron transfer property.

Chemical Formula (A)

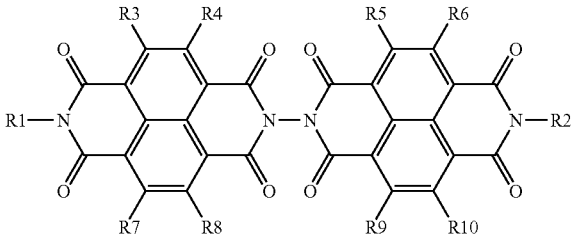

When the material is diluted with an organic solvent and applied to a substrate to form a layer, initially the image bearing member has extremely excellent characteristics. However, it is found that there is a problem. That is, after the repetitive use of the image bearing member for a long period of time in an image forming apparatus, the residual voltage thereof gradually increases. Such a rise in the residual voltage of an image bearing member leads to the rise of the voltage at irradiation portions (ground portion voltage in the positive-positive development and image portion voltage in the negative-positive development), which causes production of abnormal images.

As a result of the intensive study made by the inventors of the present invention, the inventors have found that these problems can be solved by using a light source irradiating an image bearing member with light having a wavelength not shorter than 600 nm and preventing the image bearing member from being irradiated with light having a wavelength less than 600 nm.

Namely, to maintain the excellent characteristics obtained in the initial stage by using the compound represented by the chemical formula (A) for a long period of time, it is preferred to make restraint on the wavelength of light emitted from a light source for use in image irradiation in addition to the material for use in an image bearing member.

The absorption area of a charge transport layer using the compound represented by the chemical formula (A) is not longer than 450 nm. Therefore, when a light source emitting optical light, for example, white light, is used for irradiating images, the optical light mostly transmits the compound so that the light reaches a charge generating layer containing a charge generating layer. An image bearing member having such a charge transport layer is suitably used in an image forming apparatus. However, such an image bearing member has a problem that the residual voltage tends to increase during repetitive use. When the surface of an image bearing member is irradiated with light near the ultraviolet range having a high energy, an organic compound contained in a photosensitive layer is dissolved or turned into another compound. To avoid this phenomenon, for example, a method is taken in which light having a short wavelength not longer than 480 nm is cut. However, when a compound containing the compound represented by the chemical formula (A) is used, no improvement on characteristics is seen during repetitive use for a long time by cutting light having a wavelength in such a high energy range. The residual voltage increases simply by irradiation of light, i.e., with no electrostatic burden on an image bearing member. It is not clear why such phenomenon occurs to a charge transport layer containing the compound represented by the chemical formula (A) but it is considered to be due to the mutual interaction occurring during irradiation of light between the compound represented by the chemical formula (A) and other components, for example, a binder resin, a remaining solvent or a charge generating material contacting the compound at the interface, etc., which are required when forming a layer.

In the electrophotography process, other than an image irradiating device for forming latent electrostatic images, a device irradiating the surface of an image bearing member with light (referred to as discharging light) is provided between a transfer device and a charging device for uniformly charging the surface of an image bearing member after the image formation process. When such a device is provided, the same applies, i.e., the residual voltage increases during repetitive use. In the case of using discharging light, it is preferred to limit the wavelength of the discharging light to wavelength no shorter than 600 nm for repetitive use for a long time.

In the present invention, phthalocyanine is used as a charge generating material for use in a charge generating layer. When titanyl phthalocyanine is used, electric characteristics of an image bearing member are especially stable even during repetitive use. With this, quality images can be formed during a repetitive use for a long time. When there is used titanyl phthalocyanine having a spectroscopic having a CuKα X-ray diffraction spectrum having a wavelength of 1.542 Å such that a maximum peak is observed at a Bragg (2θ) angle of 27.2±0.2°, image formation is stably performed. Furthermore, it is good to use titanyl phthalocyanine having a spectroscopic having a CuKα X-ray diffraction spectrum having a wavelength of 1.542 Å such that a maximum peak is observed at a Bragg (2θ) angle of 27.2±0.2°, main peaks at a Bragg (2θ) angle of 9.4±0.2°, 9.6±0.2° and 24.0±0.2°, and a peak at a Bragg (2θ) angle of 7.3±0.2° as a lowest angle diffraction peak, and having no peak between 9.4±0.2° and 7.3±0.2°. In addition, when a polycarbonate resin is used as a binder resin for use in a photosensitive layer, the durability of an image bearing member for use in the image forming apparatus of the present invention is improved without damaging the excellent electrophotographic characteristics thereof.

When there is provided a process cartridge detachably attached to an image forming apparatus and integrally having an image bearing member and at least one of a charging device, a developing device and a cleaning device, maintenance thereof can be made easy. An image forming apparatus can have such process cartridges so that multiple image formation units (referred to as tandem system) can be structured. In the system, each unit can form a different color toner image and an image forming apparatus is obtained which can produce a full color image in a cycle. Such an image forming apparatus can have an intermediate device in which a developed toner image on an image bearing member is primarily transferred to an intermediate transfer body and the toner image thereon is transferred to a secondarily transferred to a recording medium. In this image forming apparatus, multiple color toner images are sequentially overlapped on the intermediate transfer body to form a color image. The color image is secondarily transferred to the recording medium at one time. Therefore, image formation can be stably performed irrespective of the weight of a transfer medium and the influence of carrier attachment from a development unit can be decreased.

Next, the image bearing member for use in the image forming apparatus of the present invention is described.

The image bearing member for use in the image forming apparatus of the present invention can use an electroconductive body, an electroconductively treated insulating body or an electroconductively treated paper as an electroconductive substrate. For example, metal, for example, Al, Fe, Cu and Au, or alloyed metal thereof, can be used. Also, a substrate can be used in which a thin layer of metal, for example, Al, Ag or Au, or an electroconductive material, for example, $In_2O_3$ or $SnO_2$, is formed on an insulating substrate, for example, polyester, polycarbonate, polyimide or glass. There is no specific limit to the form of an electroconductive substrate. For example, a drum form or a belt form can be used.

Next, a photosensitive layer of an image bearing member for use in the image forming apparatus of the present invention is described.

A photosensitive layer for use in the present invention has a function separated layered structure. The photosensitive layer has a charge generating layer and a charge transport layer. First, the charge generating layer is described. The charge generating layer is a layer mainly formed of a charge generating material. A binder resin can be contained if desired. Known materials can be used as the charge generating material. Specific examples thereof include phthalocyanine based pigments, for example, metal phthalocyanine or non-metal phthalocyanine, azulenium salt based pigments, methine squarate pigments, azo pigments having a carbazole skeleton, azo pigments having a triphenyl amine skeleton, azo pigments having a diphenylamine skeleton, azo pigments having a dibenzothiophene skeleton, azo pigments having a fluorenone skeleton, azo pigments having a oxadiazole skeleton, azo pigments having a bisstilbene skeleton, azo pigments having a distyryl oxadiazole skeleton, azo pigments having a distyryl carbazole skeleton, perylene based pigments, anthraquinone based or polycyclic quinone based pigments, quinone imine based pigments, diphenyl methane or triphenyl methane based pigments, benzoquinone or naphthoquinone based pigments, cyanine or azomethine based pigments, indigoid based pigments, and bisbenzimidazole base pigments. These charge generating materials can be used alone or in combination.

Among these, when titanyl phthalocyanine having titan as the central metal represented by the following chemical formula (1) is used, a high sensitive photosensitive layer can be obtained. Thereby, it is possible to reduce the size of an electrophotographic machine and improve the performance speed thereof.

Chemical Formula 1

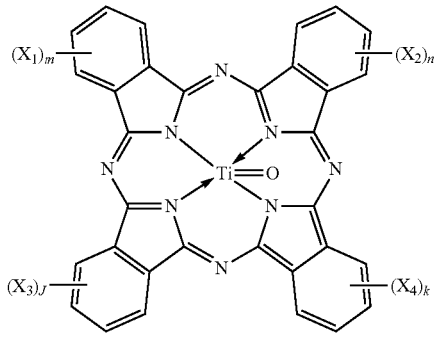

In the formula, $X_1$, $X_2$, $X_3$ and $X_4$ independently represent a halogen atom and n, m, j and k independently represent 0 or an integer of 1, 2, 3, or 4.

JOP S57-148745. S59-36254, S59-44054, S59-31965, S61-239248, S62-67094, etc., describe synthesis methods and electrophotographic characteristics of titanyl phthalocyanine. It is known that there are various kinds of crystalline forms of titanyl phthalocyanine. JOP S59-49544, S59-166959, S61-239248, S62-67094, S63-366, S63-116158, S64-17066, 2001-19871, etc., describe titanyl phthalocyanine having a different crystalline form.

Among the crystalline forms, titanyl phthalocyanine having a spectroscopic having a CuKα X-ray diffraction spectrum having a wavelength of 1.542 Å such that a maximum peak is observed at a Bragg (2θ) angle of 27.2±0.2° is suitably used because the titanyl phthalocyanine has especially excellent sensitivity characteristics and is stable in terms of voltage so that the voltage at irradiated portion does not increase. Furthermore, JOP 2001-19871 describes titanly phthalocyanine having a spectroscopic having a CuKα X-ray diffraction spectrum having a wavelength of 1.542 Å such that a maximum peak is observed at a Bragg (2θ) angle of 27.2±0.2°, main peaks at a Bragg (2θ) angle of 9.4±0.2°, 9.6±0.2 and 24.0±0.2°, and a peak at a Bragg (2θ) angle of 7.3±0.2 as a lowest angle diffraction peak, and having no peak between 9.4±0.2° and 7.3±0.2°. An image bearing member using this titanyl phthalocyanine can maintain charging property during repetitive use without loosing its high sensitivity. This image bearing member is stable so that the voltage at irradiated portions does not rise.

In addition, when titanyl phthalocyanine crystal has an average particle diameter not greater than 0.60 μm, an image bearing member can be obtained which can maintain charging property during repetitive use without loosing its high sensitivity. Furthermore, the anti-background fouling characteristics can be extremely improved. This is because, when the particle diameter is too large, the contact area easily decreases and the charge generation efficiency tends to deteriorate.

Specific examples of binder resins for use in the charge generating layer include polyamide, polyurethane, epoxy resins, polyketone, polycarbonate, silicone resins, acryl resins, polyvinyl butyral, polyvinyl formal, polyvinyl ketone, polystyrene, poly-N-vinyl carbazole and polyacryl amide. These binder resins can be used alone or in combination. A charge transport material can be added if desired.

As a method of forming a charge generating layer, a casting method from a solution dispersion system can be used. A charge generating layer can be provided by a casting method in which the charge generating mentioned above is dispersed optionally with a binder resin in a solvent, for example, tetrahydrofuran, cyclohexanone, dioxane, dichloroethane, or butanone, with a ball mill, an attritor, a sand mill or the like, and the liquid dispersion is suitably diluted for application. The diluted liquid dispersion can be applied using a dip coating method, a spray coating method and a beat coating method.

The layer thickness of the charge generating layer provided as described above is suitably from about 0.01 to about 5 μm and preferably from 0.05 to 2 μm.

Next, the charge transport layer is described.

The charge transport layer is formed by dissolving a charge transport material and a binder resin in a solvent, for example, tetrahydrofuran cyclohexanone, dioxane, dichloroethane or butanone, and applying the liquid dispersion. A dip coating method, a spray coating method and a beat coating method can be used for application.

Specific examples of binder resins which can be used in a charge transport layer include polycarbonate (e.g., bisphenol A type, bisphenol Z type, bisphenol C type, or copolymers thereof), polyarylate, polysulfone, polyester, methacryl resin, polystyrene, vinyl acetate, epoxy resins, and phenoxy resins which have a good filming property. Among these, polycarbonate resins are preferred due to their good anti-abrasion property. These binder resins can be used alone or in combination.

The charge transport material for use in the present invention is the compound represented by the chemical formula (A). When the compound represented by the chemical formula (A) is contained in a photosensitive layer, an image forming apparatus can be obtained which can achieve high speed charge transportability that is unattainable in a typical electrophotographic apparatus. Namely, such an image forming apparatus can have a clear difference between the charging voltage and the voltage at irradiated portions, which leads to production of quality images. The compound represented by the chemical formula (A) is extremely stable against an active gas, for example, ozone or nitrogen oxide gas. Using this compound is advantageous when a charging device in an electrophotographic apparatus produces such active gasses. This is because the compound represented by the chemical formula (A) has a strong basic at N-th order in terms of molecular structure so that the compound has a durability against the gasses mentioned above. Therefore, an image forming apparatus can be obtained which has an excellent chemical durability in addition to the mechanical strength and electric durability described above. in light of designing various kinds of electrophotographic image forming apparatus, it is possible to prevent increase in size or cost increase. Therefore, it is possible to provide a user with an inexpensive apparatus with easy installation.

$R_1$ and $R_2$ in the compound represented by the chemical formula (A) independently represent a hydrogen atom, a substituted or non-substituted alkyl group, a substituted or non-substituted cycloalkyl group, a substituted or non-substituted aralkyl group. $R_3$, $R_4$, $R_5$, $R_6$, $R_7$, $R_8$, $R_9$ and $R_{10}$ independently denote a hydrogen atom, a halogen atom, cyano group, nitro group, amino group, hydroxyl group, a substituted or non-substituted alkyl group, a substituted or non-substituted cycloalkyl group, a substituted or non-substituted aralkyl group. Specific examples of the halogen atom include a fluorine atom, a chlorine atom, a bromine atom, and an iodine atom.

Specific examples of the substituted or non-substituted alkyl group include an alkyl group having 1 to 25 carbon atoms, and preferably from 1 to 10 carbon atoms. Specific examples thereof include a straight chain group, for example, methyl group, ethyl group, n-propyl group, n-butyl group, n-pentyl group, n-hexyl group, n-heptyl group, n-octyl group, n-nonyl group and n-decyl group, a branched chain group, for example, i-propyl group, s-butyl group, t-butyl group, methyl propyl group, dimethyl propyl group, ethyl propyl group, diethyl propyl group, methylbutyl group, dimethyl butyl group, methyl pentyl group, dimethyl pentyl group, methyl hexyl group and dimethyl hexyl group, alkoxy alkyl group, monoalkyl amino alkyl group, dialkyl amino alkyl group, halogenated alkyl group, alkyl carbonyl alkyl group, carboxy alkyl group, alkanoyloxy alkyl group, aminoalkyl group, an alkyl group substituted by an esterified or non-esterified carboxyl group, and alkyl groups substituted by a cyano group. There is no specific limit to the substituted position. The substituted alkyl groups include a group in which part of the carbon atoms in the substituted or non-substituted alkyl group is substituted by a hetero atom (N, O, S, etc.).

Specific examples of the substituted or non-substituted cycloalkyl group include an alkyl group having 3 to 25 carbon atoms, and preferably from 3 to 10 carbon atoms. Specific examples thereof include same series rings from cyclopropane to cyclodecane, a group having an alkyl substituted group, for example, methyl cyclopentane, dimethyl cyclopentane, methylcyclohexane, dimethylcyclohexane, trimethylcyclohexane, tetramethylcyclohexane, ethylcyclohexane, diethylcyclohexane, and t-butylcyclohexane, and cycloalkyl groups substituted by an alkoxyalkyl group, a monoalkylaminoalkyl group, a dialkylaminoalkyl group, a halogenated alkyl group, an alkoxycarbonyl alkyl group, a carboxy alkyl group, an alkanoyloxy alkyl group, an aminoalkyl group, a halogen atom, amino group, an esterified or no-esterified carboxyl group or cyano group. The substituted cycloalkyl groups include a group in which part of the carbon atoms in the substituted or non-substituted cycloalkyl group is substituted by a hetero atom (N, O, S, etc.).

Specific examples of the substituted or non-substituted aralkyl group include the above-mentioned substituted or non-substituted alkyl group having an aromatic ring as a substitution group and such an aralkyl group preferably has 6 to 14 carbon atoms. Specific examples thereof include benzyl group, perfluorophenylethyl group, 1-phenylethyl group, 2-phenyl ethyl group, terphenyl ethyl group, dimethylphenylethyl group, diethylphenyl ethyl group, t-butylphenyl ethyl group, 3-phenylpropyl group, 4-phenylbutyl group, 5-phenylpentyl group, 6-phenyl hexyl group, benzhydryl group, and trityl group.

To be more specific, the charge transport materials represented by the following chemical formulae (2) to (6) are especially preferred in terms of the charging voltage during repetitive use and the stability of the voltage at irradiated portions. In the formulae, Me represents methyl group.

Chemical Formula 2

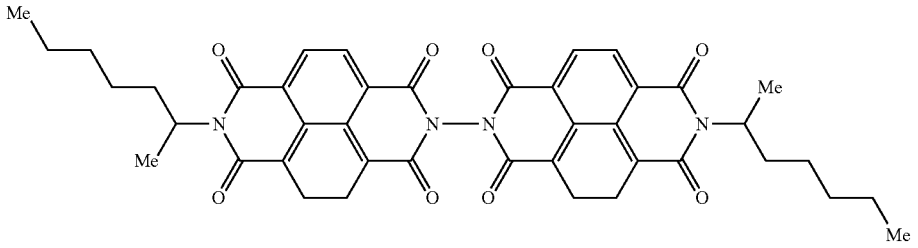

Chemical Formula 3

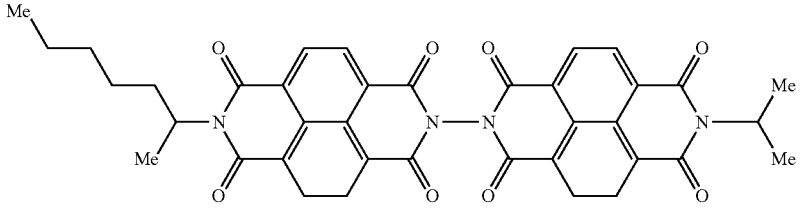

Chemical Formula 4

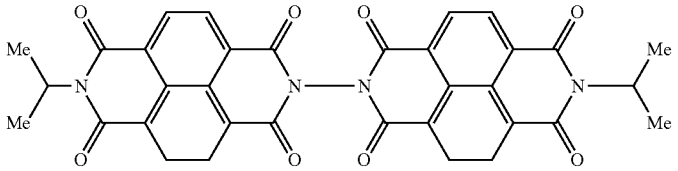

Chemical Formula 5

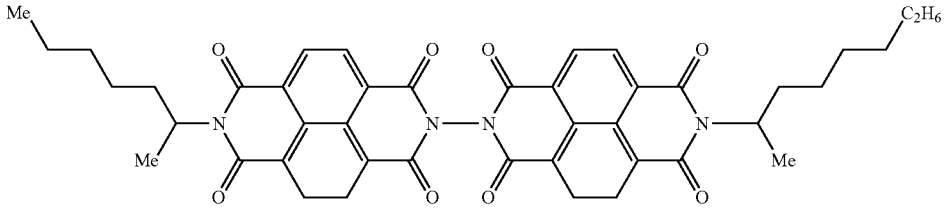

-continued

Chemical Formula 6

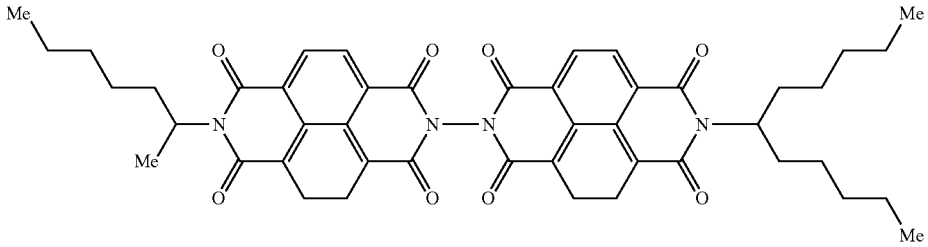

Typical synthesis method and manufacturing method of the charge transport material represented by the chemical formula (A) are as follows:

Naphthalene carbide, which is used as a material in the following method, is synthesized according to the following reaction formula based on the method described in, for example, U.S. Pat. No. 6,794,102 or Industrial Organic Pigments 2$^{nd}$ edition, VCH, 485 (1997).

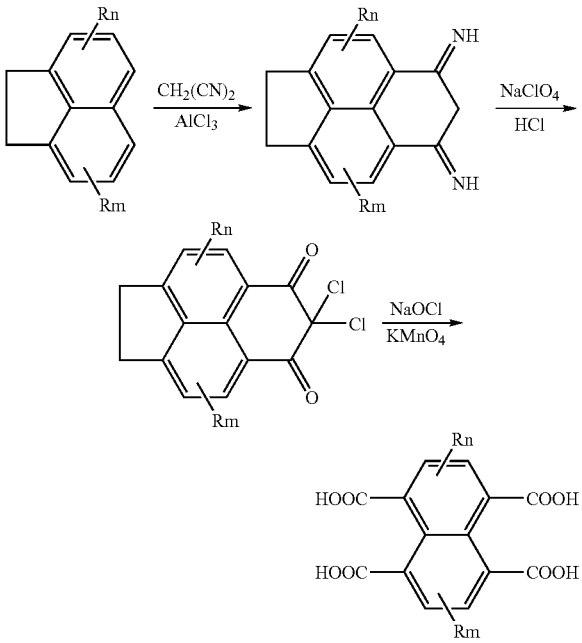

In the chemical reaction formula, $R_n$ represents $R_3$, $R_4$, $R_5$ or $R_6$, and $R_m$ represents $R_5$, $R_6$, or $R_7$.

The charge transport material represented by the chemical formula (A) for use in the present invention is obtained by a method in which naphthalene carbide or anhydrate thereof is reacted with an amine for monoimidization, or a method in which naphthalene carbide or anhydrate thereof is pH-adjusted by a buffer solution followed by reaction with a diamine. Monoimidization is performed with no solvent or under the presence of a solvent. There is no specific limit to the solvent. It is preferred to use a solvent which reacts in the temperature range of from 50 to 250° C. with no reaction with materials or products. Specific examples thereof include benzene, toluene, xylene, chloronaphthalene, acetic acid, pyridine, methylpyridine, dimethyl formamide, dimethylacetamide, dimethylethylene urea, and dimethyl sulfoxide. As for pH-adjustment, a buffer solution obtained by mixing a basic solution, for example, lithium hydroxide or potassium oxide, with an acid, for example, phosphoric acid, is used. Carboxylic acid derivative dehydration reaction in which a carboxylic acid and an amine or diamine are reacted is performed with no solvent or under the presence of a solvent. There is no specific limit to the solvent. It is preferred to use a solvent which reacts in the temperature range of from 50 to 250° C. with no reaction with materials or products. Specific examples thereof include benzene, toluene, chloronaphthalene, bromonaphthalene and acetic acid anhydride. Either of the reactions can be performed irrespective of the presence of a catalyst. There is no specific limit to such a catalyst. Molecular sieves, benzene sulfonate, p-toluene sulfonate, etc., can be used as a dehydrating agent.

The charge transport materials represented by the chemical formulae (2) to (6) illustrated above are manufactured by the following methods.

Charge Transport Material Represented by Chemical Formula (2)

First Process

Place 5.0 g (18.6 mmol) of 1,4,5,8-naphthalene tetracarboxylic acid dianhydride and 50 ml of DMF in a flask (200 ml) and reflux the mixture while heating: Drop a mixture of 2.14 g (18.6 mmol) of 2-aminoheptane and 25 ml of DMF in the flask while stirring: After the reaction, cool the container and condense with a reduced pressure: Add toluene to the residue and refine with silica gel column chromatography: and re-crystallize the resultant by toluene/hexane to obtain 2.14 g (yield constant: 31.5%) of monoimide body A.

Second Process

Place 2.0 g (5.47 mmol) of monoimide body A and 0.137 g (2.73 mmol) of hydrazine monohydrate, 10 mg of p-toluene sulfonate and 50 ml of toluene in a flask (100 ml) and reflux the mixture while heating for 5 hours: After the reaction, cool the container and condense with a reduced pressure: Refine the residue with silica gel column chromatography: and re-crystallize the resultant by toluene/ethyl acetate to obtain 0.668 g (yield constant: 33.7%) of the compound represented by the chemical formula (2).

Charge Transport Material Represented by Chemical Formula (3)

First Process

Place 10.0 g (37.3 mmol) of 1,4,5,8-naphtahalene tetracarboxylic acid dianhydride and 0.931 g (18.6 mmol) of hydrazine monohydrate, 20 mg of p-toluene sulfonate and 100 ml of toluene in a flask (200 ml) and reflux the mixture while heating for 5 hours: After the reaction, cool the container and condense with a reduced pressure: Refine the residue with silica gel column chromatography: and re-crystallize the resultant by toluene/ethyl acetate to obtain 2.84 g (yield constant: 28.7%) of dimer C.

Second Process

Place 2.5 g (4.67 mmol) of the dimer C and 30 ml of DMF in a flask (100 ml) and reflux the mixture while heating: Drop a mixture of 0.278 g (4.67 mmol) of 2-aminopropane and 10 ml of DMF in the flask while stirring: Subsequent to dropping, cool the container and condense with a reduced pressure: And add toluene to the residue and refine with silica gel column chromatography to obtain 0.556 g (yield constant: 38.5%) of monoimide body C.

Third Process

Place 0.50 g (1.62 mmol) of monoimide body C and 10 ml of DMF in a flask (50 ml) and reflux the mixture while heating: Drop a mixture of 0.186 g (1.62 mmol) of 2-aminoheptane and 5 ml of DMF in the flask while stirring: Subsequent to dropping, reflux the mixture for 6 hours while heating: After the reaction, cool the container and condense with a reduced pressure: Add toluene to the residue and refine with silica gel column chromatography: and re-crystallize the resultant by toluene/hexane to obtain 0.243 g (yield constant: 22.4%) of the compound represented by the chemical formula (3).

Charge Transport Material Represented by Chemical Formula (4)

First Process

Place 5.0 g (18.6 mmol) of 1,4,5,8-naphtahalene tetracarboxylic acid dianhydride and 50 ml of DMF in a flask (200 ml) and reflux the mixture while heating: Drop a mixture of 1.10 g (18.6 mmol) of 2-aminopropane and 25 ml of DMF in the flask while stirring: Subsequent to dropping, reflux the mixture for 6 hours while heating: After the reaction, cool the container and condense with a reduced pressure: Add toluene to the residue and refine with silica gel column chromatography: and re-crystallize the resultant by toluene/hexane to obtain 2.08 g (yield constant: 36.1%) of monoimide body B.

Second Process

Place 2.0 g (6.47 mmol) of monoimide body B and 0.162 g (3.23 mmol) of hydrazine monohydrate, 10 mg of p-toluene sulfonate and 50 ml of toluene in a flask (100 ml) and reflux the mixture while heating for 5 hours: After the reaction, cool the container and condense with a reduced pressure: Refine the residue with silica gel column chromatography: and re-crystallize the resultant by toluene/ethyl acetate to obtain 0.810 g (yield constant: 37.4%) of the charge transport material represented by the chemical formula (4).

Charge Transport Material Represented by Chemical Formula (5)

First Process

Place 5.0 g (9.39 mmol) of the dimer C mentioned above and 50 ml of DMF in a flask (200 ml) and reflux the mixture while heating: Drop a mixture of 1.08 g (9.39 mmol) of 2-aminoheptane and 25 ml of DMF in the flask while stirring: Subsequent to dropping, cool the container and condense with a reduced pressure: And add toluene to the residue and refine with silica gel column chromatography to obtain 1.66 g (yield constant: 28.1%) of monoimide body D.

Second Process

Place 1.5 g (2.38 mmol) of monoimide body D and 50 ml of DMF in a flask (100 ml) and reflux the mixture while heating: Drop a mixture of 0.308 g (2.38 mmol) of 2-aminooctane and 10 ml of DMF in the flask while stirring: Subsequent to dropping, reflux the mixture for 6 hours while heating: After the reaction, cool the container and condense with a reduced pressure: Add toluene to the residue and refine with silica gel column chromatography: and re-crystallize the resultant by toluene/hexane to obtain 0.328 g (yield constant: 18.6%) of the charge transport material represented by the chemical formula (5).

Charge Transport Material Represented by Chemical Formula (6)

First Process

Place 5.0 g (9.39 mmol) of the dimer C mentioned above and 50 ml of DMF in a flask (200 ml) and reflux the mixture while heating: Drop a mixture of 1.08 g (9.39 mmol) of 2-aminoheptane and 25 ml of DMF in the flask while stirring: Subsequent to dropping, cool the container and condense with a reduced pressure: And add toluene to the residue and refine with silica gel column chromatography to obtain 1.66 g (yield constant: 28.1%) of monoimide body D.

Second Process

Place 1.5 g (2.38 mmol) of monoimide body D and 50 ml of DMF in a flask (100 ml) and reflux the mixture while heating: Drop a mixture of 0.408 g (2.38 mmol) of 2-aminoundecane and 10 ml of DMF in the flask while stirring: Subsequent to dropping, reflux the mixture for 6 hours while heating: After the reaction, cool the container and condense with a reduced pressure: Add toluene to the residue and refine with silica gel column chromatography: and re-crystallize the resultant by toluene/hexane to obtain 0.276 g (yield constant: 14.8%) of the charge transport material represented by the chemical formula (6).

The content ratio of the charge transport material represented by the chemical formula (A) is preferably from 10 to 70 wt % and more preferably from 30 to 60 wt % based on the total solid portion of an entire charge transport layer. When the addition amount is too large, problems tend to occur such that anti-abrasion property and duration for the charging voltage may deteriorate and dark decay tends to rise. When the addition amount is too small, problems tend to occur such that the electrostatic contrast or the effect of restraining the occurrence of abnormal images may not be not sufficiently obtained.

The layer thickness of the charge transport layer provided as described above is suitably from 5 to 100 μm and preferably from 10 to 35 μm.

In the present invention, a leveling agent can be added in a photosensitive layer. Specific examples of the leveling agent include silicone oils, for example, dimethyl silicone oil, methyl phenyl silicone oil and polymers or oligomers having perfluoroalkyl group in its branched chain. The content thereof is suitably from 0 to 1 part by weight based on 100 parts by weight of a binder resin.

In the present invention, to improve the anti-environment property, especially to prevent deterioration of sensitivity and rise of the residual voltage, it is possible to add anti-oxidant. An anti-oxidant can be added in any layer containing an organic compound. When an antioxidant is added in a charge transport layer, a good result can be obtained.

Specific examples of the antioxidant for use in the present invention include the following.

Monophenol Based Compound 2,6-di-t-butyl-p-cresol, butylated hydroxyl anisol, 2,6-di-t-butyl-4-ethylphenol, and stearyl-β-(3,5-di-t-butyl-4-hydroxyphenyl)propionate.

Bisphenol Based Compound 2,2'-methylene-bis-(4-methyl-6-t-butylphenol), 2,2'-methylene-bis(4-ethyl-6-t-butylphenol), 4,4'-thiobis-(3-methyl-6-t-butylphenol), and 4,4'-butylidenebis-(3-methyl-6-t-butylphenol).

Phenol Based Polymer 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyohenyl)propionate]methane, bis[3,3'-bis(4'-hydroxy-3'-t-butylphenyl)butylic acid]glycol ester, and tocophnols.

Paraphenylenediamines

N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, and N,N'-dimethyl-N,N'-di-t-butyl-p-phenylene diamine.

Hydroquinones 2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone.

Organic Sulfur Compound

Dilauryl-3,3-thiodipropionate, distearyl-3,3'-thiodipropionate, and ditetradecyl-3,3'-thiodipropionate.

Organic Phosphoric Compound

Triphenylphosphine, tri(nonylphenyl)phosphine, tri(di-nonylphenyl)phosphine, tricresyl phosphine, and tri(2,4-dibutylphenoxy)phosphine.

These compounds are known as antioxidants for rubber, plastic and oil and market products thereof can be easily obtained. The addition amount of antioxidant in the present invention is 0.1 to 100 parts by weight and preferably from 2 to 30 parts by weight based on 100 parts of a charge transport material.

An intermediate layer can be optionally provided between an electroconductive substrate and a photosensitive layer for the image bearing member of the present invention. Typically, such an intermediate layer is mainly formed of a resin. Considering that a photosensitive layer is applied on an intermediate layer, such a resin is desired to be hardly soluble in a typical organic solvent. Specific examples of the resins include water-soluble resins, for example, polyvinyl alcohol, casein, sodium polyacrylate, alcohol-soluble resins, for example, copolymer nylon and methoxymethylated nylon, and curing resins forming three dimensional mesh structure, for example, polyurethane, melamine resins, alkyd resins and epoxy resins. In addition, fine powder of metal oxides, for example, titanium oxide, silica, alumina, zirconium oxide, tin oxide and indium oxide, metal sulfide or metal nitride can be added in an intermediate layer as a filler to stably maintain the charging properties. These intermediate layers can be formed by using a suitable solvent and a suitable application method. The layer thickness thereof is from 0.1 to 20 μm and preferably from 0.5 to 10 μm.

Next, an image forming apparatus for use in the present invention is described with reference to the accompanying drawings. Any image bearing member illustrated in any drawing is an embodiment of the image bearing member of the present invention.

FIG. 1 is a schematic diagram illustrating an example of the image bearing member of the image forming apparatus of the present invention. The variant examples described later of the image bearing members illustrated in any diagrams do not depart from the scope of the present invention.

In FIG. 1, an image bearing member 11 is an embodiment of the present invention.

The image bearing member 11 has a drum form. A sheet form or an endless belt form can be also used.

Any known charging device, for example, a corotron, a scorotron, a solid state charger or a charging roller, can be used as a charging device 12.

The above-mentioned charging device can be used as a transfer device 16 and a combination of a transfer charger and a detachment charger is preferably used.

A numeral reference 13 represents an irradiating device. In the image forming apparatus of the present invention, any irradiating device having a light source which can emit light having a wavelength not shorter than 600 nm can be used. A combination of a typical light source and a various kind of filter, for example, a sharp cut filter, a bandpass filter, a near-infrared cut filter, a dichroic filter, an interference filter, a color conversion filter can be used to irradiate an image bearing member with only light having a wavelength not shorter than 600 nm. Such filters can be used alone or in combination. It is preferred to select a laser diode (LD), a light emitting diode (LED) or the like in terms of the stability of light source wavelength. A numeral reference 19 represents a fixing device.

1A represents an optional discharging device. Any light source can be used for the discharging device 1A as long as the light source emits light having a wavelength not shorter than 600 nm. A combination of a typical light source, for example, a halogen lamp, and a various kind of filter, for example, a sharp cut filter, a bandpass filter, a near-infrared cut filter, a dichroic filter, an interference filter, a color conversion filter can be used to irradiate an image bearing member with only light having a wavelength not shorter than 600 nm. It is preferred to select a laser diode (LD), a light emitting diode (LED) or the like in terms of the stability of light source wavelength as in the case of the irradiating device.

A toner 15 used for development on the image bearing member 11 by a developing device 14 is transferred to an image receiving medium 18 with some toner remaining on the image bearing member 11. Such remaining toner is removed from the image bearing member 11 by a cleaning device 17. A rubber cleaning blade, or a brush, for example, a fur brush or a magfur brush, can be used as the cleaning device 17.

After positively or negatively charging and irradiating the image bearing member 11, a positive or negative latent electrostatic image is formed on the surface of the image bearing member 11. When the positive or negative latent electrostatic image is developed with a toner having a negative or positive polarity, a positive image is obtained. When the positive or negative latent electrostatic image is developed with a toner having a positive or negative polarity, a negative image is obtained. Any known method can be applied to the developing device 14 and also any known method can be applied to the discharging device 1A.

In the present invention, it is suitable to have an image formation unit as illustrated in FIG. 1 in a multiple number. These image formation units can be arranged side by side in the horizontal direction or a suitably angled direction.

Figure 2:
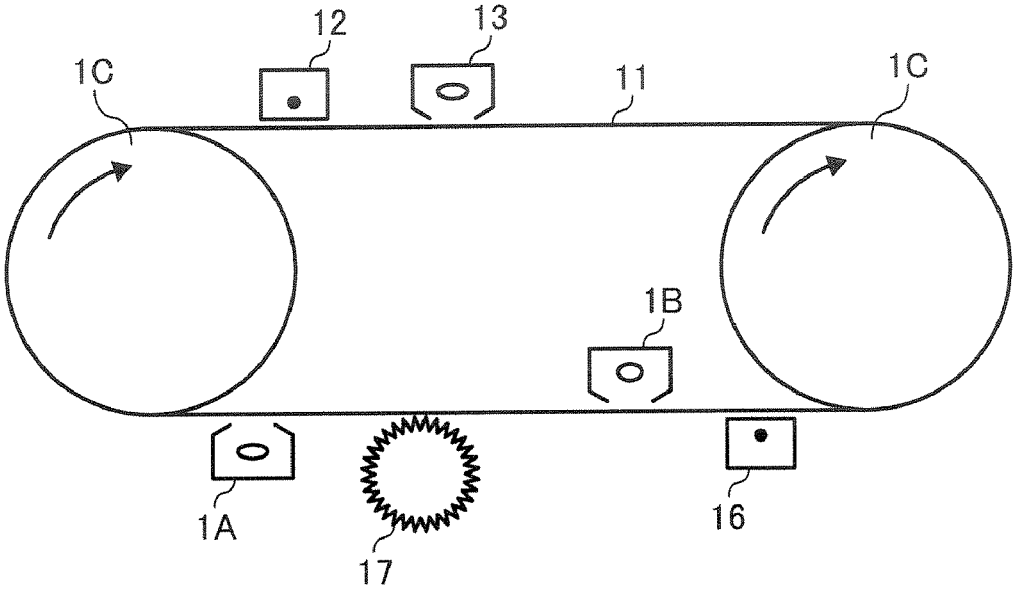
FIG. 2 is a cross section illustrating another example of the image forming apparatus of the present invention.

FIG. 2 is a diagram illustrating another example of the image forming apparatus of the present invention. In FIG. 2, the image bearing 11 has an endless belt form.

The image bearing member 11 is driven by a driving device 1C, charged by the charging device 12, irradiated by the irradiating device 13, developed by a developing device (not shown), transferred by a transfer device 16, irradiated before cleaning by a pre-cleaning irradiating device 1B, cleaned by the cleaning device 17 and discharged by the discharging device 1A. These are repeatedly performed. In FIG. 2, the image bearing member 11 (the substrate is translucent in this case) is irradiated from the side of the substrate for pre-cleaning irradiation.

As the irradiating device 13 in FIG. 2, a laser diode (LD), a light emitting diode (LED) or the like which emits light having a wavelength not shorter than 600 nm. If desired, a various kind of filter, for example, a sharp cut filter, a bandpass filter, a near-infrared cut filter, a dichroic filter, an interference filter, a color conversion filter can be used to irradiate the image bearing member 11 with only light having a wavelength in the desired range.

In the present invention, it is suitable to have an image formation unit as illustrated in FIG. 2 in a multiple number.

These image formation units can be arranged side by side in the horizontal direction or a suitably angled direction.

The image forming apparatuses described above are embodiments for the purpose of illustration only and can take a form of another embodiment. For example, the pre-cleaning irradiation is performed from the substrate side in FIG. 2. It is also possible to irradiate the image bearing member from the photosensitive layer side as long as the light source emits light having a wavelength not shorter than 600 nm. Image irradiation and/or discharging irradiation can be performed from the substrate side (as long as the discharging light source emits light having a wavelength not shorter than 600 nm).

Irradiation before transfer, pre-irradiation before image irradiation and discharging irradiation are illustrated in the drawings. Also other known irradiation processes can be provided in addition to the image irradiation, the pre-cleaning irradiation and the discharging irradiation. The light emitted in those irradiation processes is required to have a wavelength not shorter than 600 nm. The characteristics during repetitive use can be significantly improved when irradiation is performed not with light having a wavelength shorter than 600 nm.

The image forming unit described above can be implemented in a photocopier, a facsimile machine, or a printer. Also, the image forming unit can be therein as a form of a process cartridge. The process cartridge is a device including an image bearing member with optional devices, for example, a charging device, a developing device, a transfer device, a cleaning device or a discharging device. Such a process cartridge can take a various kind of form. A process cartridge illustrated in FIG. 3 is an example.

Such a process cartridge can be detachably attached to an image forming apparatus and easily maintained. A numeral reference 20 represents a developing roller.

Figure 3:
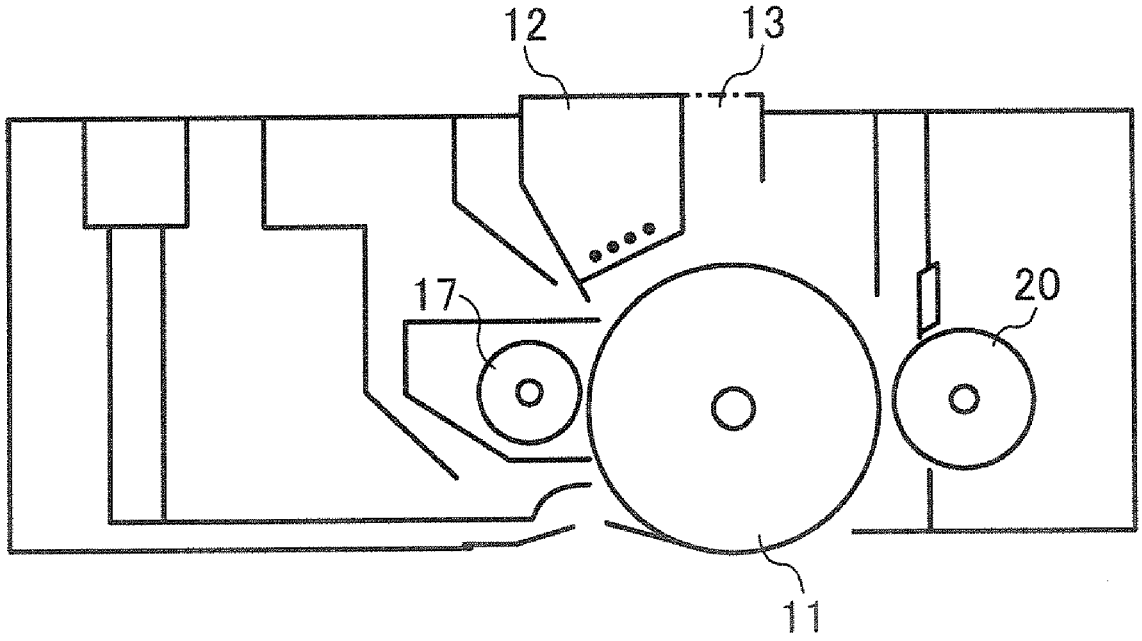
FIG. 3 is a cross section illustrating an example of the process cartridge of the present invention.

In the present invention, it is suitable to have a process cartridge as illustrated in FIG. 3 in a multiple number. These image formation units can be arranged side by side in the horizontal direction or a suitably angled direction.

Figure 4:
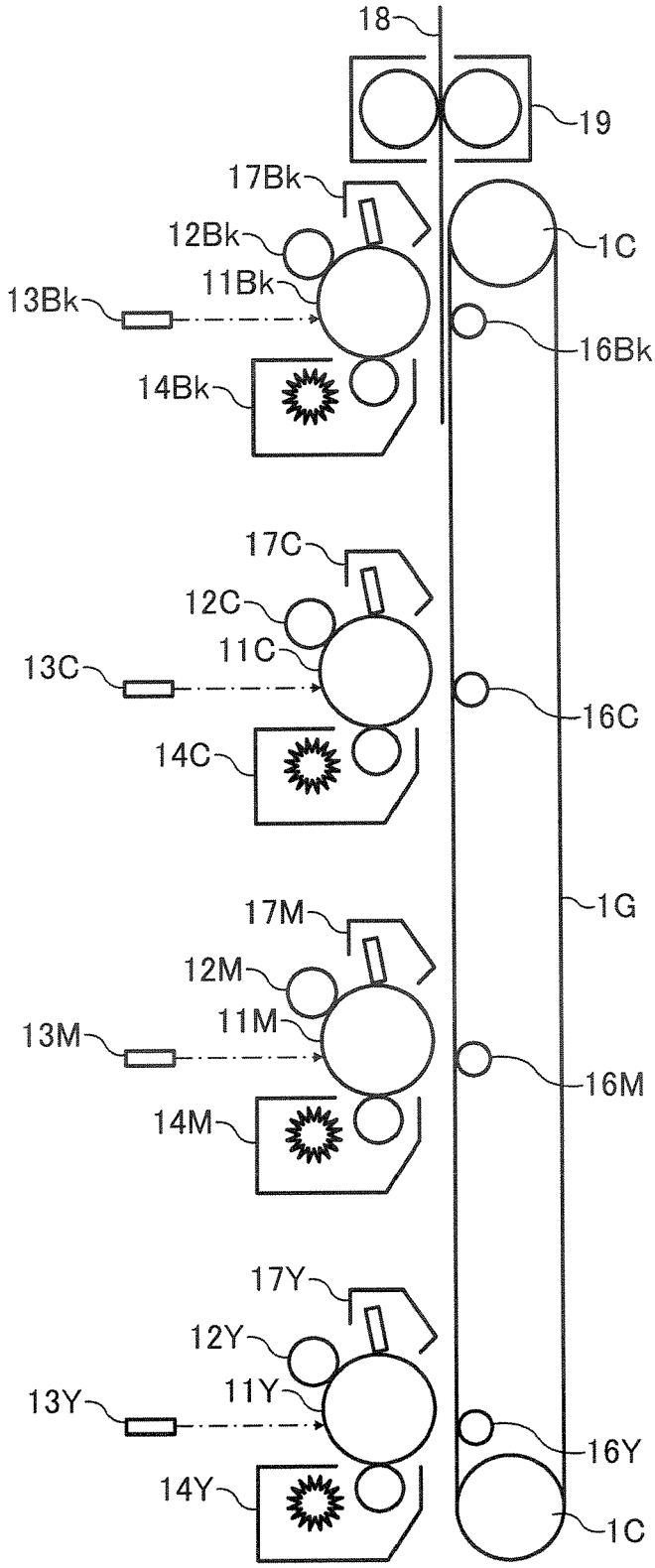
FIG. 4 is a cross section illustrating an example of the full color image forming apparatus of the present invention.
Figure 5:
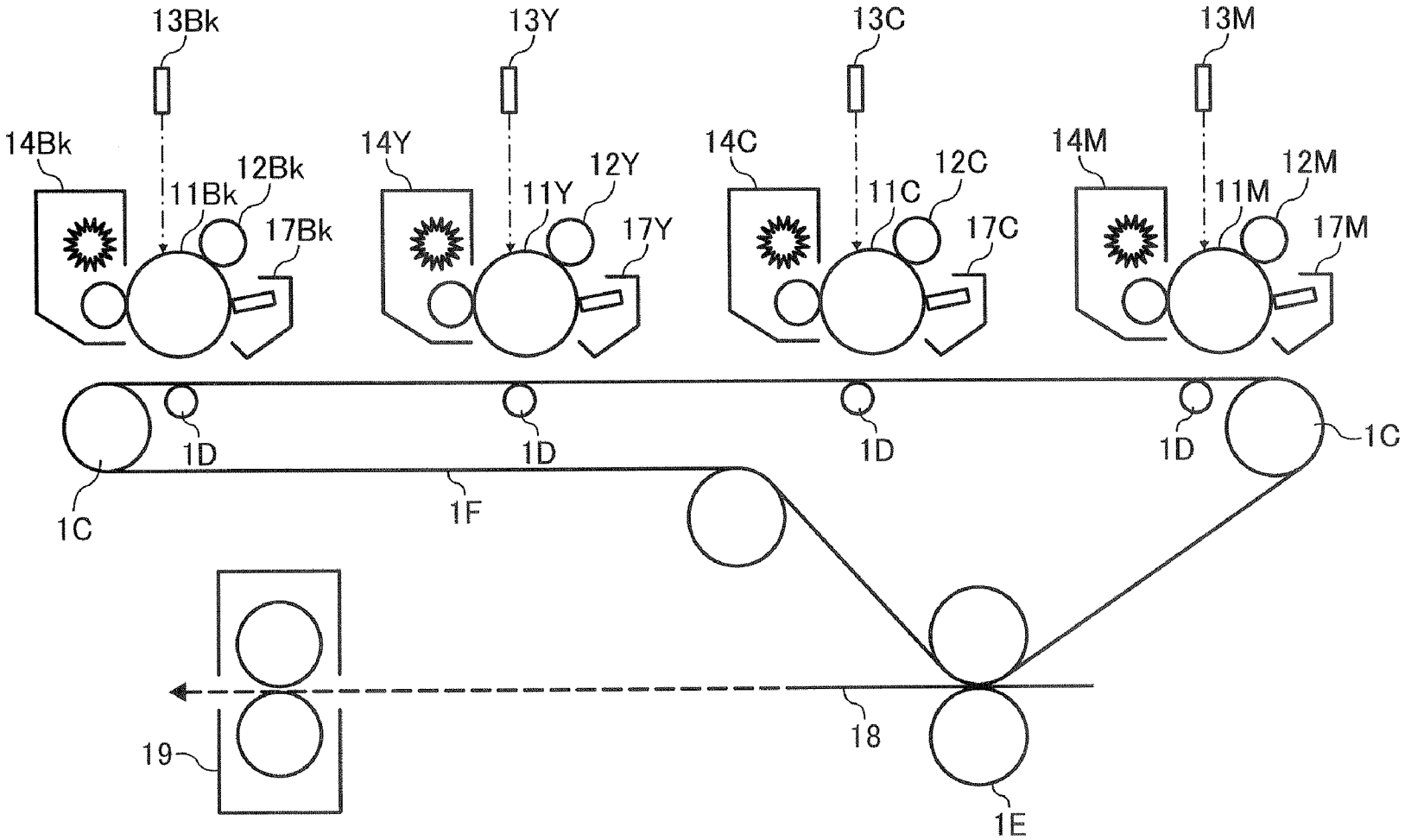
FIG. 5 is a cross section illustrating another example of the full color image forming apparatus of the present invention.

In FIGS. 4 and 5, part of the full color image forming apparatus of the present invention is illustrated. In this image forming apparatus, 4 color toners, i.e., yellow (Y), magenta (M), cyan (C) and black (Bk) toners, are used. An image formation unit is provided for each color. Additionally, an image bearing member 11 (i.e., 11Y, 11M, 11C and 11Bk), is provided for each color of yellow (Y), magenta (M), cyan (C) and black (Bk), respectively. Around the image bearing member 11 (11Y, 11M, 11C and 11Bk), a charging device 12 (Y, M, C and Bk), an irradiating device 13 (Y, M, C and Bk), a developing device 14 (Y, M, C and Bk) and a cleaning device 17 (Y, M, C and Bk) are provided.

There is no specific limit to the irradiation device 13 (Y, M, C and Bk) as long as the irradiation device 13 (Y, M, C and Bk) has a light source emitting light having a wavelength not shorter than 600 nm as described above.

A combination of a typical light source, for example, a halogen lamp, and a various kind of filter, for example, a sharp cut filter, a bandpass filter, a near-infrared cut filter, a dichroic filter, an interference filter, a color conversion filter can be used to irradiate an image bearing member with only light having a wavelength not shorter than 600 nm. It is preferred to select a laser diode (LD), a light emitting diode (LED) or the like in terms of the stability of light source wavelength as in the case of the irradiating device.

A transfer conveyor belt 1G functioning as a transfer body bearing member is suspended over a driving device 1C. The transfer conveyor belt 1G is detached and attached to each image bearing member 11Y, 11M, 11C and 11Bk arranged in a straight line at each transfer position. A transfer device 16 (Y, M, C and Bk) is provided opposing the image bearing member 11 (1Y, 1M, 1C and 1Bk) with the transfer conveyor belt 1G therebetween.

The process cartridge described above which can be detachably attached to an image forming apparatus can be used for each color image formation unit.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is further described with reference to the following Examples but not limited thereto.

The image bearing member for use in Example 1 is manufactured as follows:

Image Bearing Member for Use in Example 1

Liquid application for each layer is prepared as follows:

Liquid Application for Intermediate Layer

The following recipe is mixed with a ball mill device (aluminum ball having a Φ of 5 mm is used as media) for 5 days to prepare a liquid application for an intermediate layer.

| | |
|---|---|
| Alkyd resin (BECKOLITE M6401-50, manufactured by Dainippon Ink and Chemicals Incorporated) | 11 parts |
| Melamine resin (SUPERBECAKMINE G-821-60, manufactured by Dainippon Ink and Chemicals Incorporated) | 6 parts |
| Titanium oxide (CR-EL, manufactured by Ishihara Industry Co., Ltd.) | 48 parts |
| Methylethylketone | 186 parts |

Liquid Application for Charge Generating Layer

The following recipe is mixed with a bead mill dispersion device (PSZ ball having a Φ of 0.5 mm is used as media) for 120 minutes to prepare a liquid application for a charge generating layer.

| | |
|---|---|
| Non-metal phthalocyanine pigment (Fastogen Blue8120B, manufactured by Dainippon Ink and Chemicals Incorporated) | 12 parts |
| Polyvinylbutyral (BL-1, manufactured by Sekisui Chemical Co., Ltd.) | 9 parts |
| Cyclohexanone | 270 parts |

Liquid Application for Charge Transport Layer

The following recipe is stirred and dissolved to prepare a liquid application for a charge transport layer.

| | |
|---|---|
| Charge transport material represented by the chemical formula (2) synthesized by the method described above | 10 parts |
| Polycarbonate resin (Z POLICA, viscosity average molecular weight: 50,000, manufactured by Teijin Chemicals Ltd.) | 10 parts |
| Tetrahydrofuran | 120 parts |
| 1% silicone oil tetrahydrofuran solution (silicone oil = KF50-100CS, manufactured by Shin-Etsu Chemical Co., Ltd.) | 0.2 parts |

Next, the liquid application for intermediate layer, the liquid application for charge generating layer, and the liquid application for charge transport layer, are sequentially applied on an aluminum drum having a diameter of 30 mm and a length of 340 mm by a dip coating method. The intermediate layer, the charge generating layer and the charge transport layer are dried at 135° C. for 30 minutes, at 110° C. for 15 minutes and at 120° C. for 20 minutes, respectively. These are formed under the coating condition such that the layer thickness of the intermediate layer is 4.5 μm, the layer thickness of the charge generating layer is 0.15 μm, and the layer thickness of the charge transport layer is 27.8 μm.

Example 1

The image bearing member prepared for Example 1 as described above is installed in a digital multi-function machine remodeled based on imagio MF2230, (manufactured by Ricoh, Co., Ltd.) with such a change that the power supply is changed and the power supply is changed and the charging polarity is changed to positive polarity for evaluation.

A laser diode (LD) of 780 nm is used as the writing image irradiation unit in this image forming apparatus. A light-emitting diode (LED) of 660 nm is used as the discharging irradiation unit (hereinafter referred to as discharging device) for discharging performed after transfer and before charging.

With this image forming apparatus, photocopying tests are performed and after the initial copy and 10,000$^{th}$ copy, evaluation is made for the following items.

Voltage at Irradiated Portion

The voltage at irradiated portions when a solid image is written is evaluated under the condition of the initial surface voltage (charging voltage) of the image bearing member being 800 V.

Image Quality

For the output images, image density, black dots, white dots, black streaks, white streaks for the black solid portion are comprehensively evaluated. The results are shown in Table 1.

TABLE 1

| | Charge transport material represented by Chemical formula (A) | Optical wavelength (nm) of image irradiation device | Optical wavelength (nm) of discharging device | Evaluation: Initial: Voltage (V) at irradiated portion | Evaluation: Initial: Image quality | Evaluation: After 10,000 printing: Voltage (V) at irradiated portion | Evaluation: After 10,000 printing: Image quality |
|---|---|---|---|---|---|---|---|
| Example 1 | Chemical formula (2) | 780 | 660 | 155 | Good | 165 | Good |

Image Bearing Member for Use in Example 2

Image Bearing Member for use in Example 2 is manufactured in the same manner described as in Example 1 except that the non-metal phthalocyanine for use in the liquid application for the charge generating layer is replaced with a titanyl phthalocyanine pigment, which is prepared according to the method of synthesis example 1 described below.

Synthesis Example 1 of Titanyl Phthalocyanine for Use in Image Bearing Member for Example 2

A pigment is prepared according to JOP 2001-19871 as follows: Mix 29.2 g of 1,3-diiminoisoindoline and 200 ml of sulfolane; Drop 20.4 g of titanium tetrabuthoxido to the mixture in a nitrogen atmosphere; Subsequent to dropping, heat the resultant gradually to 180° C.; Stir the resultant for 5 hours for reaction while keeping the reaction temperature between 170 to 180° C.; After the reaction, cool down the resultant for precipitation and filter the precipitated material; Wash the filtered material with chloroform until the obtained powder becomes blue; Wash the powder with methanol several times; Wash the resultant with 80° C. hot water followed by drying to obtain coarse titanyl phthalocyanine: Dissolve the coarse titanyl phthalocyanine in concentrated sulfuric acid in an amount of 20 times the weight of the coarse titanyl phthalocyanine: Drop the resultant to iced water in an amount of 100 times the amount of the coarse titanyl phthalocyanine while stirring: Filter the precipitated crystal: Wash the crystal with water until the cleaning water becomes neutral (pH of the deionized water after washing is 6.8) to obtain a wet cake (water paste) of titanyl phthalocyanine pigment: Place 40 g of this wet cake of titanyl phthalocyanine pigment in 200 g of tetrahydrofuran: And after a 4-hour stirring, filter the resultant followed by drying to obtain powder of titanyl phthalocyanine [Pigment 1].

Figure 6:
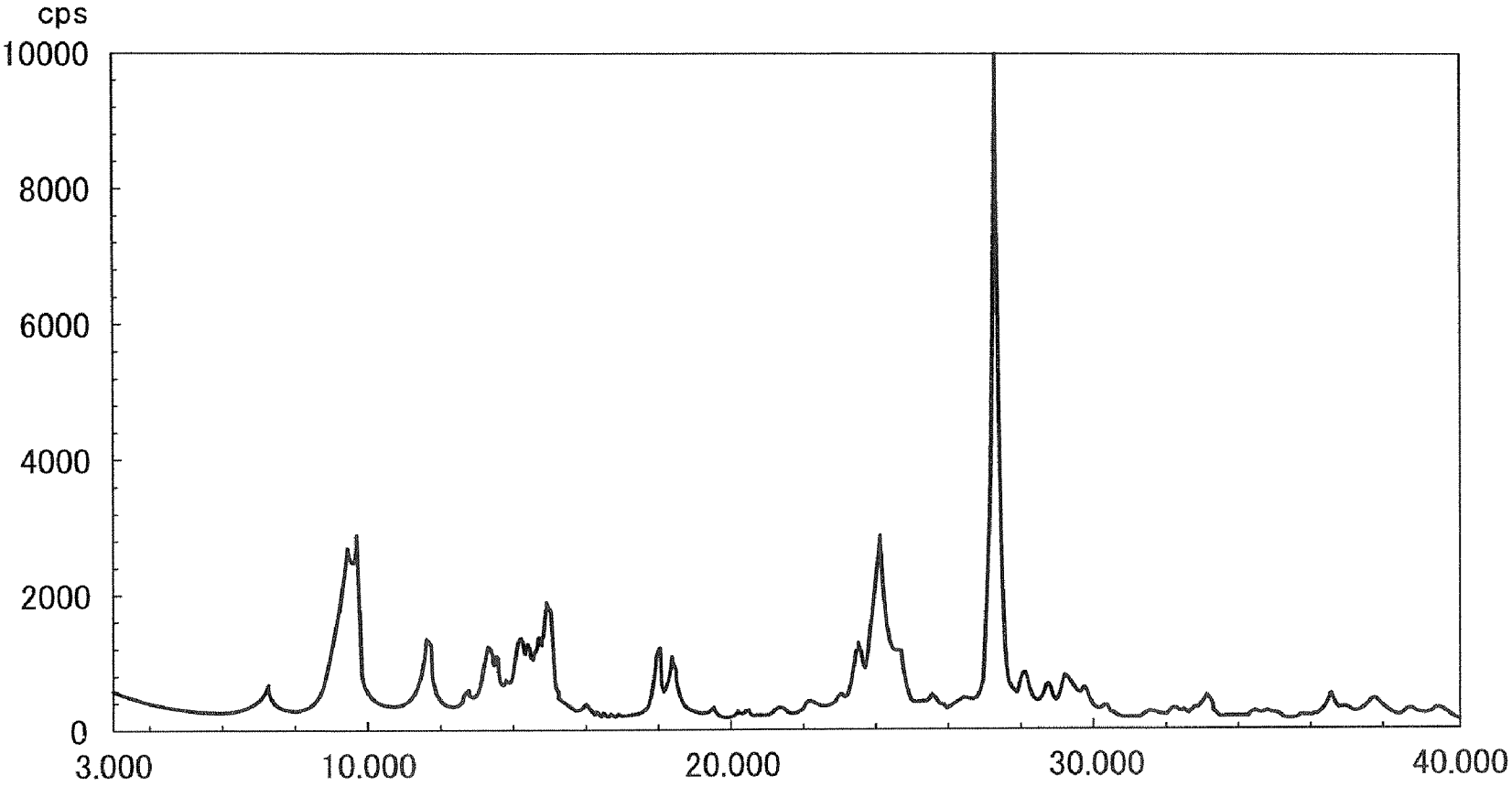
FIG. 6 is a graph illustrating the result of X ray diffraction of titannyl phthalocyanine powder for use in the present invention.

The density of the solid portion of the wet cake is 15 wt %. The weight ratio of the crystal conversion solvent to the wet cake is 33 times. The obtained titanyl phthalocyanine powder is measured for X ray diffraction spectrum under the following condition. The titanyl phthalocyanine powder has a CuKα X-ray diffraction spectrum having a wavelength of 1.542 Å such that a maximum peak is observed at a Bragg (2θ) angle of 27.2±0.2°, and the lowest angle diffraction peak is observed at a Bragg (2θ) angle of 7.3±0.2°, and having no peak between 9.4±0.2 and 7.3±0.2°. The result of X ray diffraction is shown in FIG. 6.

The average particle size in the liquid application for charge generating layer containing this titanyl phthalocyanine is 0.29 μm when measured by CAPA-700, manufactured by Horiba Ltd.

X ray diffraction spectrum measuring conditions

X ray tube: Cu

Voltage: 50 kV

Current: 30 mA

Scanning speed: 2°/min

Scanning area: 3 to 40°

Time constant: 2 seconds

Image Bearing Member for Use in Example 3

Image Bearing Member for use in Example 3 is manufactured in the same manner described as in Image Bearing Member for use in Example 2 except that the charge transport material represented by the chemical formula (2) for use in the liquid application for the charge transport layer is replaced with the charge transport material represented by the chemical formula (3), which is synthesized according to the method described above.

Image Bearing Member for Use in Example 4

Image Bearing Member for use in Example 4 is manufactured in the same manner described as in Image Bearing Member for use in Example 2 except that the charge transport material represented by the chemical formula (2) for use in the liquid application for the charge transport layer is replaced with the charge transport material represented by the chemical formula (4), which is synthesized according to the method described above.

Image Bearing Member for Use in Example 5

Image Bearing Member for use in Example 5 is manufactured in the same manner described as in Image Bearing Member for use in Example 2 except that the charge transport material represented by the chemical formula (2) for use in the liquid application for the charge transport layer is replaced with the charge transport material represented by the chemical formula (5), which is synthesized according to the method described above.

Image Bearing Member for Use in Example 6

Image Bearing Member for use in Example 6 is manufactured in the same manner described as in Image Bearing Member for use in Example 2 except that the charge transport material represented by the chemical formula (2) for use in the liquid application for the charge transport layer is replaced with the charge transport material represented by the chemical formula (6), which is synthesized according to the method described above.

Image Bearing Member for Use in Comparative Example 1

Image Bearing Member for use in Comparative Example 1 is manufactured in the same manner described as in Image Bearing Member for use in Example 2 except that the charge transport material represented by the chemical formula (2) for use in the liquid application for the charge transport layer is replaced with the charge transport material represented by the following chemical formula (B)

Chemical formula (B)

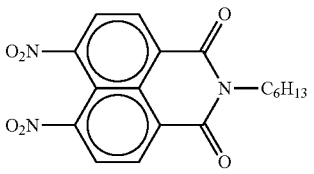

Image Bearing Member for Use in Comparative Example 2

Image Bearing Member for use in Comparative Example 2 is manufactured in the same manner described as in Image Bearing Member for use in Example 2 except that the charge transport material represented by the chemical formula (2) for use in the liquid application for the charge transport layer is replaced with the charge transport material represented by the following chemical formula (C).

Chemical Formula (C)

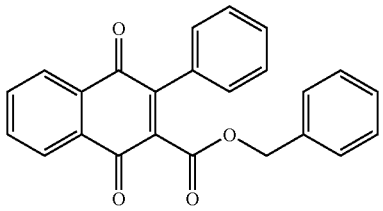

Image Bearing Member for Use in Comparative Example 3

Image Bearing Member for use in Comparative Example 2 is manufactured in the same manner described as in Image Bearing Member for use in Example 4 except that the charge transport material represented by the chemical formula (2) for use in the liquid application for the charge transport layer is replaced with the charge transport material represented by the following chemical formula (D).

Chemical formula (D)

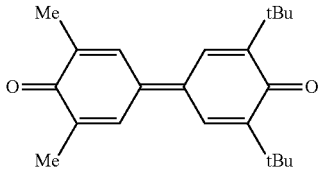

Examples 2 to 6 and Comparative Examples 1 to 3

The image bearing members prepared for Examples 2 to 6 and Comparative Examples 1 to 3 as described above are installed in a digital multi-function machine remodeled based on imagio MF2230, (manufactured by Ricoh, Co., Ltd.) with such a change that the power supply is changed and the charging polarity is changed to positive polarity for evaluation.

A laser diode (LD) of 780 nm is used as the writing image irradiation unit in this image forming apparatus. A light-emitting diode (LED) of 660 nm is used as the discharging device.

With this image forming apparatus, photocopying tests are performed for each image bearing member and after the initial copy and 10,000$^{th}$ copy, evaluation is made for the following items. However, this evaluation for the photocopying test is not made for the image forming apparatus producing an abnormal image from the beginning.

Voltage at Irradiated Portion

The voltage at irradiated portions when a solid image is written is evaluated under the condition of the initial surface voltage (charging voltage) of the image bearing member being 800 V.

Image Quality

For the output images, image density, black dots, white dots, black streaks, white streaks for the black solid portion are comprehensively evaluated. The results of Examples 2 to 6 and Comparative Examples 1 to 3 are shown in Table 2.

TABLE 2

| | Charge transport material represented by Chemical formula (A) | Optical wavelength (nm) of image irradiation device | Optical wavelength (nm) of discharging device | Evaluation: Initial: Voltage (V) at irradiated portion | Evaluation: Initial: Image quality | Evaluation: After 10,000 printing: Voltage (V) at irradiated portion | Evaluation: After 10,000 printing: Image quality |
|---|---|---|---|---|---|---|---|
| Example 2 | Chemical formula (2) | 780 | 660 | 110 | Good | 120 | Good |
| Example 3 | Chemical formula (3) | 780 | 660 | 110 | Good | 130 | Good |
| Example 4 | Chemical formula (4) | 780 | 660 | 120 | Good | 125 | Good |
| Example 5 | Chemical formula (5) | 780 | 660 | 130 | Good | 145 | Good |
| Example 6 | Chemical formula (6) | 780 | 660 | 100 | Good | 105 | Good |
| Comparative Example 1 | Charge transport material (B) | 780 | 660 | 260 | Decrease in image density | Evaluation cancelled | |
| Comparative Example 2 | Charge transport material (C) | 780 | 660 | 310 | Decrease in image density | Evaluation cancelled | |
| Comparative Example 3 | Charge transport material (D) | 780 | 660 | 330 | Decrease in image density | Evaluation cancelled | |

Example 7

Example 7 is performed and evaluated in the same manner as in Example 2 except that the image irradiation light source for use in the image forming apparatus for the evaluation is changed from the LD unit of 780 nm to an LD unit of 655 nm.

Example 8

Example 8 is performed and evaluated in the same manner as in Example 2 except that the image irradiation light source for use in the image forming apparatus for the evaluation is changed from the LD unit of 780 nm to an LD unit of 637 nm.

Example 9

Example 9 is performed and evaluated in the same manner as in Example 2 except that the image irradiation light source for use in the image forming apparatus for the evaluation is changed from the LD unit of 780 nm to an LD unit of 740 nm.

Example 10

Example 10 is performed in the same manner as in Example 2 except that the image irradiation light source for use in the image forming apparatus for the evaluation is changed from the LD unit of 780 nm to an LD unit of 760 nm.

Example 11

Example 11 is performed and evaluated in the same manner as in Example 2 except that the discharging light source for use in the image forming apparatus for the evaluation is changed from the LED unit of 660 nm to an LED unit of 610 nm.

Example 12

Example 12 is performed and evaluated in the same manner as in Example 2 except that the discharging light source for use in the image forming apparatus for the evaluation is changed from the LED unit of 660 nm to an LED unit of 760 nm.

Comparative Example 4

Comparative Example 4 is performed and evaluated in the same manner as in Example 2 except that the discharging light source for use in the image forming apparatus for the evaluation is changed from the LED unit of 660 nm to a slit irradiation system using a halogen lamp (white light).

Comparative Example 5

Comparative Example 5 is performed and evaluated in the same manner as in Comparative Example 4 except that a filter is used for the halogen lamp to use the wavelength in the range of from 530 to 550 nm (the value at half value width of the peak wavelength).

Comparative Example 6

Comparative Example 6 is performed and evaluated in the same manner as in Comparative Example 4 except that a filter is used for the halogen lamp to use the wavelength in the range of from 580 to 600 nm (the value at half value width of the peak wavelength).

Comparative Example 7

Comparative Example 7 is performed and evaluated in the same manner as in Example 2 except that the image forming apparatus is changed to an analogue photocopier remodeled based on Spirio 1510 (manufactured by Ricoh Co., Ltd.) with such a change that the power supply is changed and the charging polarity is changed to positive polarity for evaluation.

In this image forming apparatus, an image irradiation unit (for writing light) using a halogen lamp with slit irradiation is used and an LED of 660 nm is used as a discharging device.

With this image forming apparatus, photocopying tests are performed and after the initial copy and 10,000$^{th}$ copy, evaluation is made for the following items.

Voltage at Irradiated Portion

The voltage at irradiated portion (white portion, i.e., background portion) when a solid image is written is evaluated under the condition of the initial surface voltage (charging voltage) of the image bearing member being 800 V.

Image Quality

For the output images, image density, black dots, white dots, black streaks, white streaks for the black solid portion are comprehensively evaluated for Comparative Example 7.

The results of Examples 7 to 12 and Comparative Examples 4 to 7 are shown in Table 3.

TABLE 3

| | Charge transport material represented by Chemical formula (A) | Optical wavelength (nm) of image irradiation device | Optical wavelength (nm) of discharging device | Evaluation: Initial: Voltage (V) at irradiated portion | Evaluation: Initial: Image quality | Evaluation: After 10,000 printing: Voltage (V) at irradiated portion | Evaluation: After 10,000 printing: Image quality |
|---|---|---|---|---|---|---|---|
| Example 7 | Chemical formula (2) | 635 | 660 | 130 | Good | 120 | Good |
| Example 8 | Chemical formula (2) | 637 | 660 | 145 | Good | 130 | Good |
| Example 9 | Chemical formula (2) | 740 | 660 | 120 | Good | 125 | Good |
| Example 10 | Chemical formula (2) | 760 | 660 | 110 | Good | 145 | Good |
| Example 11 | Chemical formula (2) | 780 | 610 | 100 | Good | 105 | Good |
| Example 12 | Chemical formula (2) | 780 | 760 | 100 | Good | 105 | Good |
| Comparative Example 4 | Chemical formula (2) | 780 | White light | 130 | Good | 450 | Decrease in image density |
| Comparative Example 5 | Chemical formula (2) | 780 | 540 | 130 | Good | 330 | Decrease in image density |
| Comparative Example 6 | Chemical formula (2) | 780 | 590 | 130 | Good | 260 | Decrease in image density |
| Comparative Example 7 | Chemical formula (2) | White light | 660 | 160 | Good | 450 | Decrease in image density |

In the case of the image forming apparatus satisfying the conditions of the present invention, the results are good (quality images and high durability). On the other hand, it is found that, in Comparative Examples, which do not satisfy the conditions of the present invention, the image quality is bad at the initial stage or deteriorates during repetitive use.

What is claimed as new and desired to be secured by Letters Patent of the United States is:

1. An image forming apparatus comprising:

an image bearing member configured to bear a latent electrostatic image, the image bearing member comprising a substrate and a photosensitive layer comprising a charge generating layer and a charge transport layer, wherein the charge generating layer comprises titanyl phthalocyanine;

a charging device configured to uniformly charge a surface of the image bearing member;

an irradiating device comprising a light source, the irradiating device configured to irradiate the image bearing member to form a latent electrostatic image on the image bearing member;

a developing device configured to develop the latent electrostatic image with a toner;

a transfer device configured to transfer the developed image to a recording medium;

a cleaning device configured to clean the surface of the image bearing member; and a discharge device comprising a discharge light source configured to irradiate the surface of the image bearing member with discharge light having a wavelength not less than 600 nm from between the transfer device and the charging device, wherein the charge transport layer comprises at least one charge transport material represented by at least one compound selected from the group consisting of Chemical Formula 1

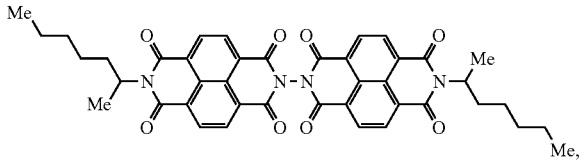

Chemical Formula 2

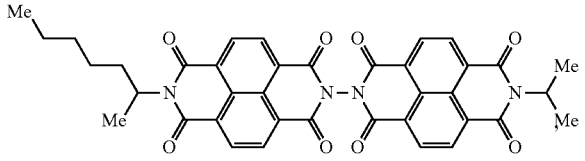

-continued

Chemical Formula 3

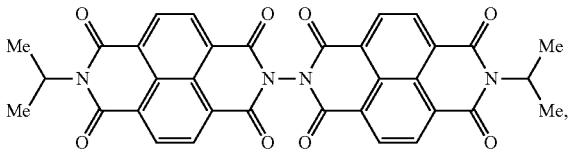

Chemical Formula 4

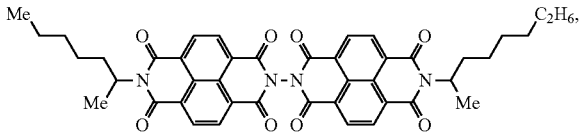

and

Chemical Formula 5

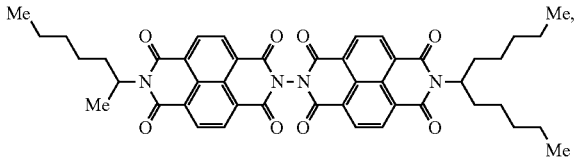

wherein the light source emits light having a wavelength not less than 600 nm and the image forming apparatus is configured such that the image bearing member is not irradiated with light having a wavelength less than 600 nm, and wherein the titanyl phthalocyanine has a spectroscopic having a CuKα X-ray diffraction spectrum having a wavelength of 1.542 Å such that a maximum peak is observed at a Bragg (2θ) angle of 27.2±0.2°, main peaks at a Bragg (2θ) angle of 9.4±0.2°, 9.6±0.2° and 24.0±0.2°, and a peak at a Bragg (2θ) angle of 7.3±0.2° as a lowest angle diffraction peak, and having no peak between 9.4±0.2° and 7.3±0.2°.

2. The image forming apparatus according to claim 1, wherein the light source is a semiconductor laser (LD) or a light-emitting diode (LED).

3. The image forming apparatus according to claim 1, wherein the photosensitive layer comprises a polycarbonate resin.

4. The image forming apparatus according to claim 1, further comprising an intermediate transfer body.

5. The image forming apparatus of claim 1 comprising a detachably attached process cartridge.

6. The image forming apparatus of claim 5 detachably attached to at least two process cartridges.

* * * * *